US008425135B2

(12) United States Patent
Rolion et al.

(10) Patent No.: US 8,425,135 B2
(45) Date of Patent: Apr. 23, 2013

(54) SYSTEM FOR MOUNTING A CLIP TO THE BODY OF A WRITING INSTRUMENT

(75) Inventors: Franck Rolion, Asnieres sur Oise (FR); Samuel Malinverni, Paris (FR)

(73) Assignee: Societe BIC, Clichy (FR)

( * ) Notice: Subject to any disclaimer, the term of this patent is extended or adjusted under 35 U.S.C. 154(b) by 354 days.

(21) Appl. No.: 12/933,616

(22) PCT Filed: Mar. 17, 2009

(86) PCT No.: PCT/FR2009/050439

§ 371 (c)(1),
(2), (4) Date: Sep. 20, 2010

(87) PCT Pub. No.: WO2009/122086

PCT Pub. Date: Oct. 8, 2009

(65) Prior Publication Data

US 2011/0013965 A1 Jan. 20, 2011

(30) Foreign Application Priority Data

Mar. 20, 2008 (FR) ..... 08 51824

(51) Int. Cl.
*B43K 23/02* (2006.01)

(52) U.S. Cl.
USPC ..... 401/131

(58) Field of Classification Search ..... 401/52, 401/195, 131, 104, 105, 106; 24/11 H, 11 PP, 24/11 RC See application file for complete search history.

(56) References Cited

U.S. PATENT DOCUMENTS

| | | | | |
|---|---|---|---|---|
| 5,336,006 | A * | 8/1994 | Badr et al. | 401/105 |
| 7,018,123 | B1 * | 3/2006 | Cetera | 401/131 |
| 8,245,359 | B2 * | 8/2012 | Fujihara et al. | 24/11 HC |

FOREIGN PATENT DOCUMENTS

| | | | |
|---|---|---|---|
| DE | 9004577 | U1 | 12/1990 |
| GB | 501523 | A | 2/1939 |

* cited by examiner

*Primary Examiner* — David Walczak
(74) *Attorney, Agent, or Firm* — Jones Day

(57) ABSTRACT

A writing instrument that includes a body extending longitudinally along a central axis (X), a clip extending in parallel to the central axis (X), from a base fixed to the body up to a free end, and a first projecting member for attaching the clip, having a first lateral side extending between a base that is integral with the body and a radially distant apex. The clip includes a bar having a first end that is integral with the base of the clip, where the body includes a second projecting attachment member having a second lateral side facing the first lateral side, the second lateral side extending from a base that is integral with the body up to an upper end from which a projection extends towards the first lateral side, up to a free end.

11 Claims, 2 Drawing Sheets

SYSTEM FOR MOUNTING A CLIP TO THE BODY OF A WRITING INSTRUMENT

CROSS-REFERENCE TO RELATED APPLICATION

This application is a national stage application of International Application No. PCT/FR2009/050439, filed on Mar. 17, 2009, which claims the benefit of French Patent Application No. 0851824 filed on Mar. 20, 2008, the contents of each application being incorporated herein by reference.

BACKGROUND OF THE EMBODIMENTS OF THE PRESENT INVENTION

1. Field of Invention

The embodiments of the present invention relate to a system for mounting a clip to the body of a writing instrument.

2. Description of Related Art

More particularly, the embodiments of the present invention relate to a writing instrument comprising a body extending longitudinally along a central axis, a clip extending substantially in parallel to the central axis, from a base fixed to the body up to a free end, and a first projecting member for attaching the clip, having a first lateral side extending between a base that is integral with the body and a radially distant apex.

For writing instruments of this type having a projecting attachment member, it is known to provide reliefs on the base of clips made of plastic, which snap-lock together with the attachment member. For clips made of metal, it is usual to insert thin metal edges into grooves of the attachment member, with serrations on these edges to slow the disengagement of the clip from the grooves.

However, it has been found that after repeated manipulations, and because of the lever arm formed by the clip, the user voluntarily or involuntarily disengages the clip from the attachment member. For clips made of plastic, the snap-lock reliefs which have necessarily reduced dimensions are then generally deformed or flattened, and can no longer perform their role of retaining the clip on the body.

A need therefore exists for a more reliable attachment of a clip onto a projecting attachment member, in particular to avoid separation of the clip from the body due to repeated pressure exerted in different directions by the user.

For this purpose, an object of the embodiments of the present invention is a writing instrument of the type described above, wherein the clip comprises a bar having a first end that is preferably integral with the base of the clip, wherein the body comprises a second projecting attachment member having a second lateral side facing the first lateral side, the second lateral side extending from a base that is integral with the body up to an upper end from which a projection extends towards the first lateral side, up to a free end, and wherein the first and second lateral sides and the projection are arranged to provide under the projection a cavity adapted to receive at least partially the bar of the clip, and to accommodate a passage for inserting a locking element in a substantially radial direction into a locked position for which it is adjusted between the first lateral side and the bar of the clip arranged in the cavity.

Adjustment of the bar between the second attachment member, the locking element, and possibly the first attachment member, allows immobilizing the corresponding position of the bar in a plane substantially perpendicular to the first and second lateral sides. Immobilization against pivoting around the bar axis which is more or less significant depending on the width of the sides and the profile of the bar, is also obtained. As this is a bar, one will understand that it is a solid element, not needing to act as an elastic member in contrast to snap-lock members. The immobilization obtained with this arrangement is therefore particularly reliable. Preventing movement in the direction of the bar can be easily obtained by the shape of its ends, and in particular by their connection to the base of the clip One should also note that the locking element is a supplemental element which, unlike the clip, is not exposed to stresses from outside elements. It is therefore easy to design the locking element such that no stresses will cause it to come out of the passage during normal use, even if the user is allowed the ability to remove it in order to change the clip.

SUMMARY OF THE EMBODIMENTS OF THE PRESENT INVENTION

In preferred embodiments of the present invention, one and/or the other of the following arrangements are used:

- the bar has a second end which is also integral with the base of the clip, and the passage for inserting the locking element is also adapted for introducing the bar in a substantially radial direction and sliding it into the cavity, which allows assembly while having a bar firmly attached to the clip,
- the base of the clip has preferably two fins to which are connected the first and second ends of the bar placed between the fins, the fins being preferably arranged to come at least partially in contact with the lateral sides adjacent to the first and second lateral sides of the first and second attachment members, the areas of contact created in this manner further increase the immobilization of the base of the clip and more particularly, fix the orientation of the bar in a radial direction,
- the clip preferably has an external surface comprising an opening through which the locking element is inserted into the passage, and the locking element has an external cap shaped to form a continuous surface with the external side of the clip in the locked position, thus the locking element does not offer a grip and the possibilities of disengaging it are reduced,
- the locking element preferably has at least one snap-lock member adapted to snap together with a retaining member in the locked position, which renders the assembled clip undetachable;
- the retaining member is preferably formed by a raised projection on the base of the clip, which increases the likelihood that the locking element cannot be locked in the passage if the base of the clip was not prepositioned relative to the attachment members;
- the bar preferably has a polygonal cross-section, of which a portion is complementary to the profile of the cavity delimited by the second attachment member; this blocks the rotation of the clip around the axis defined by the bar;
- the locking element is adapted to exert pressure from the bar against the second lateral side when in the locked position, and preferably is in the form of a fin perpendicular to the first and second lateral sides, the fin having a width that is substantially less than the width of these sides; the pressure exerted by the locking element avoids the existence of play and the relatively thin shape of the fin allows some deformation of the locking element to compensate for dimensional variations from manufacture;

the first and second lateral sides are spaced longitudinally apart from each other, and the bar from the base of the clip extends into a plane perpendicular to the central axis; and the bar and the base of the clip are shaped, relative to the first and second attachment members, so as to allow only one mounting position of the clip with the locking element in the locked position; this prevents any inverted assembly.

BRIEF DESCRIPTION OF THE DRAWINGS

Other embodiments and advantages will become apparent upon reading the following description, given as a non-limiting example, with references to the figures in which.

DETAILED DESCRIPTION OF THE INVENTION

Figure 1:
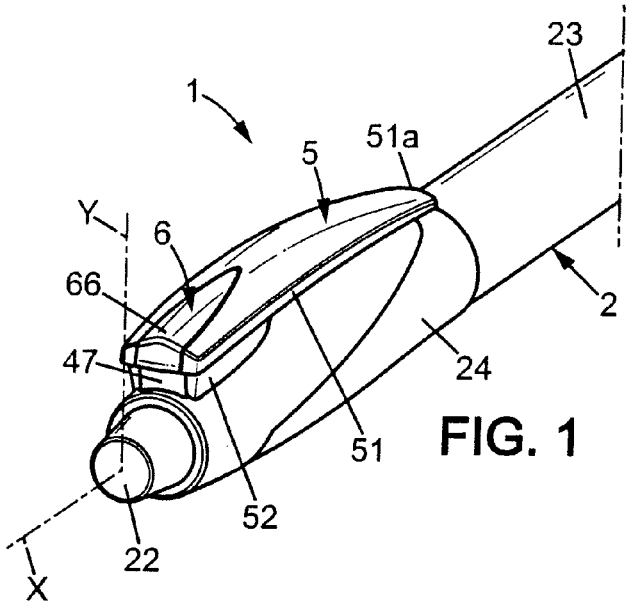
FIG. 1 is a partial perspective view of a writing instrument comprising a body, a clip, and a locking element of an embodiment of the present invention.

In the different figures, the same references are used to designate identical or similar elements. FIG. 1 represents a writing instrument 1 comprising a body 2 which has a first attachment member 3 and a second attachment member 4, both of them visible in FIG. 2. The writing instrument 1 additionally comprises a clip 5 and a lock 6.

The body 2 of the instrument extends longitudinally along a central axis X, from a rear push-button 22 up to an opposite end (not represented). In the embodiment represented, the body 2 forms a barrel formed of a substantially cylindrical front part 23 onto which the clip 5 is assembled by means of the first and second attachment members (3, 4) as will be detailed below.

Here, the instrument 1 is a mechanical pencil in which the lead is advanced by activating the rear push-button 22. However, it will be understood that the writing instrument 1 could be any type of instrument, in particular an instrument having a ball point which could be retracted by activating the rear button 22. It could also be a highlighter or a felt-tipped instrument, having a removable cap for tightly covering the tip and which can be placed on the rear end of the body in a manner that is well known. In this case, it is understood that the cap constitutes a portion of the body 2 of the instrument 1 which is likely to comprise the first and second attachment members (3, 4). Assembly of the clip 5 then requires no significant modification to the attachment members (3, 4) for the clip 5 or the lock 6.

The first attachment member 3 has a base 31 that is integral with the rear part 24 of the body 2 and extends in the radial direction Y perpendicular to the central axis X up to a apex 32. The first attachment member 3 could, however, extend in a direction that is slightly offset from the radial direction Y, as long as the apex 32 is radially distant from the body 2.

The cross-section of the first attachment member 3, transverse to the direction in which the member extends, is preferably polygonal and of variable area. This section could have a different geometry, but the section preferably includes at least a first lateral side 33 extending between the base 31 and the apex 32. In the preferred embodiment represented, this first lateral side 33 is substantially flat and oriented towards the rear end of the body 2, but it is situated at a distance from the end of the rear part 24 such that the second attachment member 4 can be placed between the first lateral side 33 and the end of the part rear 24.

In addition to the first lateral side 33, the first attachment member 3 preferably has two lateral walls 35 adjacent to the first lateral wall 33, meaning each having an edge in common with this first lateral wall 33. Here, a portion of the adjacent lateral walls 35 come together near the front end and a portion extends to form a protuberance 36 of a height that is clearly less than the radial height of the apex 32. A supplemental lateral wall 37 connects the adjacent lateral walls 35 at this protuberance 36.

A person of ordinary skill in the art will note that the first attachment member 3 has significant variations in the transverse cross-section, aside from the fact that the protuberance 36 is of reduced height. More particularly, the base 31 has a smaller cross-section than the apex 32, which uses less plastic material and avoids dimensional variations after unmolding caused by significant thicknesses of the plastic. In any case, the cross-section of the first attachment member 3 remains significant, on the same order of magnitude as the cross-section of the elongated part of the clip 5, such that this first attachment member 3 is at least comparable to the clip in its resistance to deformation.

Figure 5:
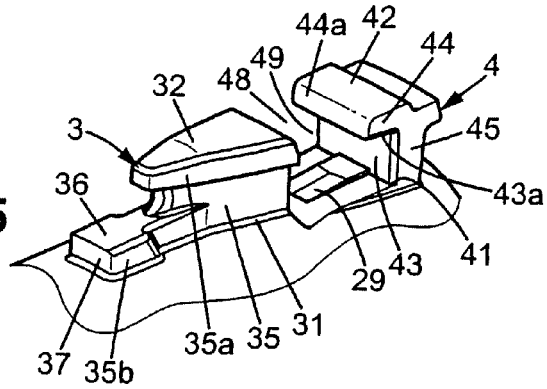
FIG. 5 is a partial enlarged perspective view of the body.

Due to the variations in the cross-section, the adjacent lateral sides 35 of the first attachment member 3 have portions of the surface which protrude relative to the rest of the surface, and in particular a portion of protruding surface 35*a* located close to the apex 32 and a portion of protruding surface 35*b* located at the protuberance 36 as shown in FIG. 5.

As illustrated in the embodiment represented, it is preferable that the first attachment member 3 is integrally molded with the rear part 24 of the body to reduce the assembly operations. However, it is quite possible for the first attachment member to be a part separate from the body, as long as it is firmly attached to it.

The second attachment member 4 has a base 41 and extends to a apex 42, in a manner analogous to that of the first attachment member 3. The transverse cross-section of the second attachment member 4 also has significant variations in its cross-section. Its minimum cross-section remains significant, however, in order to provide significant stress resistance.

The apex 42 is preferably located substantially at the level of the apex 32 of the first attachment member and is less flat in shape, although this could be otherwise designed as understood by a person of ordinary skill in the art.

The second attachment member 4 has a lateral side 43 visible in FIG. 5, referred to as the second lateral side, which preferably faces the first lateral side 33 of the first attachment member 3. To be facing each other, the first and second lateral sides (33, 43) are generally in approximately parallel planes and the respective geometric projections from them in a median plane preferably at least partially overlap. In the embodiment represented, the second lateral side 43 is therefore oriented towards the front end of the body 2 and is longitudinally spaced apart from the first lateral side 33 along the central axis X.

The second lateral side 43 also extends from the base 41, but it radially extends only to an upper end 43*a* which is located below the level of the apex 42 of this second attachment member 4. In fact, the second attachment member 4 preferably comprise a projection 44 from the upper end 43*a* of the second lateral side. The projection 44 extends towards the first lateral side 33, up to a free end 44*a*. The arrangement of this projection 44 relative to the body 2 and to the first lateral side 33 are determined by the geometry of the clip 5 and of the lock 6 as will become apparent below.

From the lateral edges on the second lateral side 43, two adjacent lateral sides 45 extend towards the back. For this second attachment member 4, the adjacent lateral sides 45 are preferably parallel to each other and are flat. A connecting side 47 joins the two adjacent lateral sides 45 and is recessed essentially for reasons of external appearance.

The first and second attachment members (3, 4) arranged in this manner define a passage 48 as indicated in FIG. 5. More specifically, the passage 48 is located between the free end 44*a* of the projection 44 from the second attachment member 4 and the first lateral side 33 of the first attachment member 3. A cavity 49 communicating with the passage 48 is also defined by the second lateral side 43, the lower side of the projection 44, and the rear part 24 forming a portion of the body 2.

A person of ordinary skill in the art will note the presence of a protruding ramp 29 in the portion of the rear part 24 which delimits the cavity 49. The ramp 29 rises to the second lateral side 43.

The clip 5 comprises an elongated element 51 extending from a base 52 to a free end 51*a*. The base 52, formed as an integral part of the elongated element 51, is situated under its external side. The base 52 is of a general U shape with the U opening towards the rear end of the body 2 in the assembled state. Due to this U shape, the base 52 has two fins (52*a*, 52*b*) which are generally parallel.

The base 52 can, however, be of a substantially different shape and be formed as a part separate from the elongated element 51, as long as it can be solidly attached to it.

The clip 5 comprises a bar 53 positioned between the fins (52*a*, 52*b*) of the base 52 and solidly attached to them by a first end 53*a* and a second end 53*b* respectively. It should be noted, however, that the bar 53 can be solidly attached to the clip 5 by only connecting one of its ends (53*a*; 53*b*) to the base 52, the other end remaining free and preferably with an enlarged head to prevent sliding through the cavity 49. The represented configuration of the bar 53 is preferred, however, for reasons of solidity in the clip assembly.

The bar 53 is preferably an elongated element having a significant cross-section, preferably on the same order of magnitude as the minimum cross-section of the first and second attachment members (3, 4) in order to resist the stresses that the clip may undergo during normal use.

Figure 3:
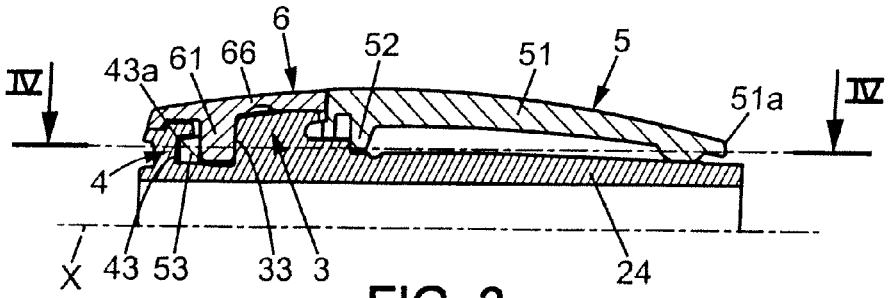
FIG. 3 is a simplified cross-sectional half view along the XY plane of FIG. 1.

In the embodiment represented and as is more clearly illustrated in FIG. 3, the bar 53 has a square polygonal cross-section of a profile that fits with the profile defined by the inner side of the projection 44, the second lateral side 43, and the ramp 29. This arrangement prevents rotation of the bar around its lengthwise axis in the cavity 49 and therefore establishes a degree of immobilization of the clip 5 relative to the body 2. However, if the bar only has to prevent one translation movement along the central axis X, it is possible for it to have a circular cross-section.

Figure 6:
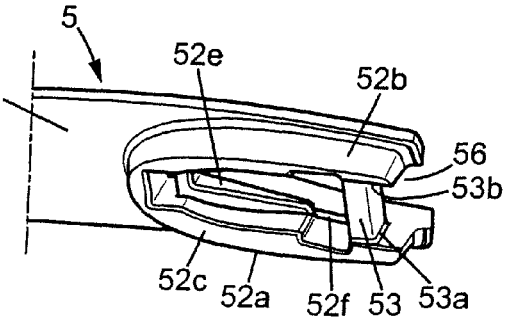
FIG. 6 is an enlarged perspective view of the clip.

The inner side 52*c* of the base 52, visible in FIG. 6, is configured to fit with the end part 24 in the assembled state and therefore to contribute to the immobilization of the clip. The internal sides, meaning those facing each other, of the fins (52*a* and 52*b*) comprise recessed areas on their surface to reduce the thickness of the material and protruding areas, more particularly a protruding area 52*e* visible in FIG. 6.

The elongated element 51 of the clip has a large opening 56 on its upper side, of a shape which substantially corresponds to the space between the fins (52*a*, 52*b*) of the base 52 and which therefore opens into this space.

To perform its function, the lock 6 essentially comprises a locking element 61 configured to be inserted through the passage 48 when the bar 53 is arranged in the cavity 49. The locking element 61 then achieves a locking position for which it is adjusted between the first lateral side 33 and the bar 53.

Figure 7:
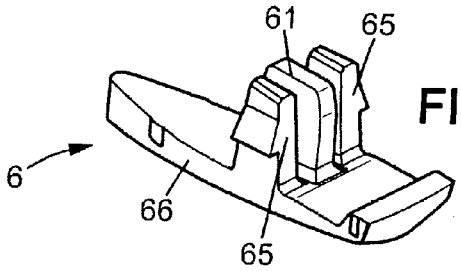
FIG. 7 is an enlarged perspective view of the locking element.

The adjustment of the locking element 61 is preferably set in a tightly manner in order to avoid any play in the assembly of the clip 5, and even with a slight stress deformation in order to accommodate dimensional variations from manufacture. For this purpose, one will note that the locking element 61 is formed by a fin which is clearly visible in FIG. 7, relatively thin in its lengthwise direction and arranged perpendicularly to the first and second lateral sides (33, 43). The width of this fin 61 is substantially less than the width of the lateral sides (33, 43) and as a result forcible insertion of the locking element 61 essentially results in its deformation, with no noticeable deformation of the first and second attachment members (3, 4). Such forcible insertion with deformation can be sufficient to prevent any removal of the lock 6 if this is judged to be necessary.

However, in addition to the locking element 61, the lock 6 has two snap-lock members 65 to prevent removal once in the locked position.

Preferably, the snap-lock members 65 cooperate with a retaining member which is preferably formed by a raised area on the base 52 of the clip 5, and more particularly the projection 52*f* on each of the inner sides of the fins (52*a*, 52*c*) visible in FIG. 6. Thus, the locked position in the passage 48 is only definitive if the clip 5 was assembled correctly beforehand, meaning with its bar 53 positioned in the cavity 49.

The lock 6 additionally comprises a cap 66 formed by a strip from which project the locking element 61 and the snap-lock members 65 arranged on each side of the locking element. The cap 66 lends an aesthetic appearance to the lock 6 in the locked position when the clip 5 is assembled, and can even create a decorative effect when plastic of a different appearance from the clip is used. One will note that the cap 66 is shaped so that its external side in the locked position forms a surface that is continuous or flush with the external side of clip 5, as is apparent in FIGS. 1 and 3. The lock 6 therefore does not offer any grip for the user. Thus, a low retaining force in the locked position, obtained with or without the snap-lock members 65, makes manual disassembly of the clip almost impossible.

Figure 2:
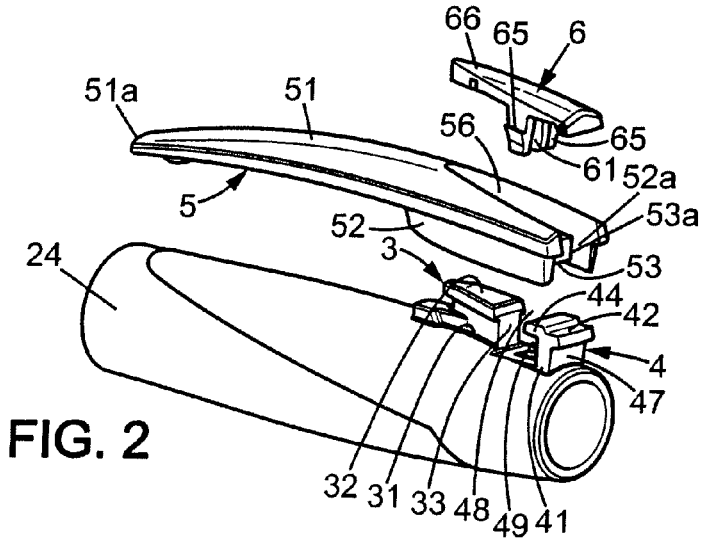
FIG. 2 is an exploded view of the main parts of FIG. 1.

We will now describe the process for mounting the clip 5 onto the body 2 of the instrument, this assembly being obtained with only the three parts (24, 5 and 6) represented in FIG. 2 and which is made particularly solid by the positive locking of the clip 5 onto the rear part 24 established with the aid of the lock 6. This mounting can easily be made irreversible.

From the configuration represented in FIG. 2, the clip 5 is brought towards the rear part 24 in a radial movement in direction Y, such that the bar 53 is inserted between the first and second attachment members (3, 4) by the passage 48, until the lower side 52*c* of the base 52 comes into contact with the rear part 24. One will note that a reversed presentation of the clip 5 will not achieve this contact, due in particular to the difference in shape of the apexes (32, 42) of the attachment members (3, 4) which are unable to enter the space inside the base when reversed.

Once in contact with the rear part 24 of the body 2, the clip 5 is slid towards the rear in a movement parallel to the central axis X. During this longitudinal translation, the bar 53 comes to rest in the cavity 49 and reaches the position represented in FIG. 3. The ramp 29 acts to guide it into this position by forcing the bar 53 under the projection 44.

During this longitudinal translation, a person of ordinary skill in the art will note that the portions of protruding surface 35*a* of the first member 3 come into contact with the walls of the clip opening 56 and that portions of fin surface (52*a*, 52*b*) come into contact with the adjacent lateral walls 45 of the second attachment member 4. This increases the immobilization of the clip preventing its pivoting in the radial direction Y.

In addition, still during this longitudinal translation, the portions of protruding surface 52*e* on the internal sides of the fins (52*a*, 52*b*) come into contact with the adjacent lateral sides 35 of the first attachment member 3, which also helps to prevent pivoting.

A person of ordinary skill in the art should also note that these portions of protruding surface 52*e* pass under the portions of protruding surface 35*a* of the first attachment member 3 which here has a T cross-section in a plane perpendicular to the central axis X. This increases the retention of the clip 5 on the body 2 if traction is applied in the external radial direction Y. Note that in this configuration where the lock is not yet in position, immobilization of the clip is already achieved to less than five degrees of freedom of motion, only a forward translation in the direction of the central axis X still being possible.

Figure 4:
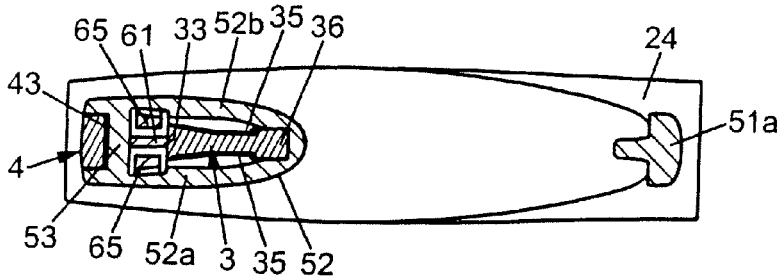
FIG. 4 is a simplified cross-sectional view along the plane of the line IV-IV in FIG. 3.

Immobilization of this last movement is achieved by inserting the lock 6 such that the locking element 61 creates a stop between the bar 53 of the clip 5 and the first lateral side 33 of the first attachment member 3, as is visible in FIGS. 3 and 4. This insertion is done with slight force in order to create stress in the locking element 61 or even to deform it, and thus eliminate all play in the assembly.

In this embodiment, insertion of the lock 6 to achieve the locked position results in an irreversible mounting of the clip 5. It is evident, however, that the mounting of the clip could be made reversible, for example by providing a relatively small gripping element on the lock 6, while maintaining a low risk of involuntary disassembly given that the assembly direction for the lock 6 (in the radial direction Y) is perpendicular to the direction of the immobilization achieved by this lock (direction parallel to the central axis X).

Of course, this embodiment is in no way limiting, and it will be apparent to a person skilled in the art that numerous structural variations can be made to the three parts represented in FIG. 2 without changing their functional role. As an example, the first and second attachment members could be arranged along the circumference of the body 2, with the lock then immobilizing the rotational movement of the clip around the central axis X. Also, a good number of functions filled by one or another of the members of a part could be filled by an equivalent member that is integral with another part.

The invention claimed is:

1. A writing instrument comprising:

a body extending longitudinally along a central axis;

a clip extending substantially in parallel to the central axis from a base fixed to the body up to a free end; and a first projecting member for attaching the clip, having a first lateral side extending between a base that is integral with the body and a radially distant apex, a locking element for immobilizing the clip once the clip is attached to said first projecting member, wherein the clip comprises a bar having a first end that is integral with the base of the clip, wherein the body comprises a second projecting attachment member having a second lateral side facing the first lateral side, the second lateral side extending from a base that is integral with the body up to an upper end from which a projection extends towards the first lateral side up to a free end, and wherein the first and second lateral sides and the projection are arranged to provide under the projection a cavity adapted to receive at least partially the bar of the clip, and to accommodate a passage for inserting the locking element in a substantially radial direction into a locked position for which the locking element is adjusted between the first lateral side and the bar of the clip arranged in the cavity.

2. A writing instrument according to claim 1, wherein the bar has a second end which is also integral with the base of the clip, and wherein the passage for inserting the locking element is also adapted for introducing the bar in a substantially radial direction and for sliding the bar into the cavity.

3. A writing instrument according to claim 2, wherein the base of the clip has at least two fins to which are connected to the first and second ends of the bar placed between the fins, the fins being arranged to come at least partially in contact with lateral sides adjacent to the first and second lateral sides of the first and second attachment members.

4. A writing instrument according to claim 1, wherein the clip has an external surface comprising an opening through which the locking element is inserted into the passage, and wherein the locking element has an external cap shaped to form a continuous surface with the external side of the clip in the locked position.

5. A writing instrument according to claim 1, wherein the locking element has at least one snap-lock member adapted to snap together with a retaining member in the locked position.

6. A writing element according to claim 5, wherein the retaining member is formed by a raised projection on the base of the clip.

7. A writing instrument according to claim 1, wherein the bar has a polygonal cross-section, of which a portion is complementary to the profile of the cavity delimited by the second attachment member.

8. A writing instrument according to claim 1, wherein the locking element is adapted to exert pressure from the bar against the second lateral side when in the locked position.

9. A writing instrument according to claim 8, wherein the locking element is in the form of a fin perpendicular to the first and second lateral sides, the fin having a width that is substantially less than the width of these sides.

10. A writing instrument according to claim 1, wherein the first and second lateral sides are spaced longitudinally apart from each other, and wherein the bar from the base of the clip extends into a plane perpendicular to the central axis.

11. A writing instrument according to claim 1, wherein the bar and the base of the clip are shaped, relative to the first and second attachment members, so as to allow only one mounting position of the clip with the locking element in the locked position.

* * * * *